US008947346B2

(12) United States Patent
van Veenendaal et al.

(10) Patent No.: US 8,947,346 B2
(45) Date of Patent: Feb. 3, 2015

(54) METHOD AND APPARATUS FOR DRIVING AN ELECTRONIC DISPLAY AND A SYSTEM COMPRISING AN ELECTRONIC DISPLAY

(75) Inventors: Erik van Veenendaal, Eindhoven (NL); Leendert Marinus Hage, Eindhoven (NL)

(73) Assignee: Creator Technology B.V., Breda (NL)

( * ) Notice: Subject to any disclaimer, the term of this patent is extended or adjusted under 35 U.S.C. 154(b) by 877 days.

(21) Appl. No.: 13/030,585

(22) Filed: Feb. 18, 2011

(65) Prior Publication Data

US 2012/0212470 A1 Aug. 23, 2012

(51) Int. Cl.
*G09G 3/34* (2006.01)
*G09G 3/20* (2006.01)

(52) U.S. Cl.
CPC ..... *G09G 3/344* (2013.01); *G09G 3/2081* (2013.01); *G09G 2310/065* (2013.01); *G09G 2300/043* (2013.01); *G09G 3/2018* (2013.01); *G09G 2340/0428* (2013.01); *G09G 2310/061* (2013.01); *G09G 2310/0251* (2013.01)
USPC ..... 345/107; 345/204

(58) Field of Classification Search
None
See application file for complete search history.

(56) References Cited

U.S. PATENT DOCUMENTS

| | | | | |
|---|---|---|---|---|
| 5,223,823 | A * | 6/1993 | Disanto et al. | 345/107 |
| 6,057,824 | A * | 5/2000 | Katakura et al. | 345/100 |
| 6,710,759 | B1 * | 3/2004 | Kondoh | 345/92 |
| 2003/0137521 | A1 | 7/2003 | Zehner et al. | |
| 2004/0036968 | A1 * | 2/2004 | Ito | 359/443 |
| 2005/0001812 | A1 | 1/2005 | Amundson et al. | |
| 2005/0195147 | A1 * | 9/2005 | Takahashi et al. | 345/94 |
| 2005/0212747 | A1 * | 9/2005 | Amundson | 345/107 |
| 2007/0018944 | A1 * | 1/2007 | Johnson et al. | 345/107 |
| 2007/0035488 | A1 * | 2/2007 | Kimura | 345/77 |
| 2007/0200874 | A1 * | 8/2007 | Amundson et al. | 345/690 |
| 2007/0273637 | A1 * | 11/2007 | Zhou et al. | 345/107 |
| 2008/0231593 | A1 * | 9/2008 | Johnson et al. | 345/107 |
| 2008/0303780 | A1 * | 12/2008 | Sprague et al. | 345/107 |
| 2009/0267969 | A1 * | 10/2009 | Sakamoto | 345/690 |
| 2010/0134537 | A1 * | 6/2010 | Nose | 345/690 |

(Continued)

FOREIGN PATENT DOCUMENTS

| | | | |
|---|---|---|---|
| CN | 101562001 | A | 10/2009 |
| CN | 101911167 | A | 12/2010 |

(Continued)

OTHER PUBLICATIONS

China Patent Office, Office Action, Patent Application Serial No. 201280009703.X, Dec. 2, 2014, China.

*Primary Examiner* — Amare Mengistu
*Assistant Examiner* — Antonio Xavier

(57) ABSTRACT

A device (B) is described for driving a bistable display (A). The device includes a processor (150) for receiving an input signal indicative for a desired luminance of said at least one pixel. The device also includes a controller (100) for determining a sequence of voltage levels to achieve a transition from a present luminance to the desired luminance. The device further includes a voltage generator (108) for generating the sequence of voltage levels. A portion of the sequence is selected from a plurality of mutually different sequence portions, to achieve mutually different luminance transitions. At least a first and a second of this plurality of sequence portions mutually have a same set of voltage levels and have the voltage levels from that set occurring the same number of times, but have the voltage levels in that set occur in a mutually different order.

11 Claims, 10 Drawing Sheets

(56) References Cited

U.S. PATENT DOCUMENTS

| | | | | |
|---|---|---|---|---|
| 2010/0289838 | A1* | 11/2010 | Markvoort et al. | 345/691 |
| 2011/0074756 | A1* | 3/2011 | Markvoort et al. | 345/211 |
| 2011/0187696 | A1* | 8/2011 | Slack et al. | 345/211 |
| 2011/0261094 | A1* | 10/2011 | Ruckmongathan | 345/697 |

FOREIGN PATENT DOCUMENTS

| | | | | | |
|---|---|---|---|---|---|
| WO | WO 2004/090857 | A1 | | 10/2004 | |
| WO | WO 2008/054210 | A2 | | 5/2008 | |
| WO | WO 2009/078711 | A1 | | 6/2009 | |
| WO | WO2009078711 | | * | 6/2009 | G09G 3/34 |

* cited by examiner

METHOD AND APPARATUS FOR DRIVING AN ELECTRONIC DISPLAY AND A SYSTEM COMPRISING AN ELECTRONIC DISPLAY

BACKGROUND

1. Field of the Invention

The present invention relates to a method for driving a bistable display.

The present invention further relates to an apparatus for driving a bistable display.

The present invention further relates to a system comprising a bistable display and an apparatus for driving the same.

2. Related Art

Multistable displays, such as electrophoretic displays, have a plurality of pixels, which may be settable with a first operating luminance level, a second operating luminance level and an intermediate operating luminance level. Electrowetting based displays are another example of a multistable display technology. Also LCD based displays have been developed having a multistable behavior. Typically, multistable displays are reflection type displays. Accordingly the luminance level is determined by a reflection level. Alternatively, a transmission type multistable display may be displayed, wherein the luminance level is determined by a transmission level. Conventionally, multistable displays are denoted as "bistable displays". This denotation will be used throughout the description. In the following the wording "luminance level" will also be briefly denoted as "luminance".

Usually, the first operating luminance level relates to "white", the second operating luminance level relates to "black" and the intermediate operating luminance level relates to "grey". In order to change image content on an electrophoretic display, new image information is written for a certain amount of time, for example during a period of 300 ms-600 ms. The refresh rate of the active-matrix is usually higher (for example 20 ms frame time for a 50 Hz display and 10 ms frame time for a 100 Hz display). Changing pixels of such display from black to white, for example, requires the pixel capacitors to be charged to a suitable control voltage for 200 ms to 300 ms, in the case where a pulse-width modulation principle is used. During this time the white particles drift towards the top (common) electrode, while the black particles drift towards the bottom electrode, for example an active-matrix back plane. Nevertheless, in order to rule out effects of earlier states of the display updating to an accurately defined new state requires an update time that is about three times longer, e.g. in the range of 600 to 900 ms. Switching to black requires a control voltage of a different polarity, and applying substantially 0 V on the pixel substantially preserves its condition. Addressing such electrophoretic display for a short time with a certain voltage will result in a situation wherein a mixture of white and black particles is visible. Alternatively, electrophoretic displays exist that use only one type of particle. Therein the perceived grey value is determined by the position of the particles with respect to the electrodes. Because the particles are very small human eyes integrate various ratios of black and white particles to shades/levels of grey. Such condition is regarded as an intermediate reflection level.

Bistable displays may have an infinite number of microstates depending on the momentaneous position and velocity of the particles that determine the luminance of the pixel. However, for practical purposes it will be presumed that the state of the pixel is one of a predetermined number of states that corresponds to a respective one of that predetermined number of grey values that is controlled by the apparatus for driving the display.

WO 2009/078711 describes a method and apparatus for controlling an electronic display having a plurality of pixels settable in a plurality of reflection levels comprising a first level, a second level and a plurality of intermediate levels. The intermediate levels form a substantially equidistant partition of a dynamic range between the first level and the second level. The method comprises the step of setting the pixels to a preparatory intermediate level immediately prior to setting the pixels in a desired level selectable from said plurality of levels. The preparatory intermediate level can be selected from two or more levels. Subsequently, pulse width modulation is used to set the pixels in said desired level starting from the selected preparatory level.

Pixels of the known electrophoretic display have a limited bit depth. For example, a 4 bit pixel has $2^4=16$ grey levels. In order to enable 32 levels (distinct shades) the pixels have to be controlled with a 5-bit driving scheme. For the known electrophoretic display for an equidistant partition of a full dynamic range of a pixel (e.g., between lightest to darkest shades), increasing the bit depth could require increasing the frame rate. Increasing the frame rate generally increases power consumption and potentially leads to a shorter product lifetime. Also, increasing the bit depth requires a higher accuracy and robustness of the method to control the display used to obtain the equidistant partitioning of the dynamic range.

SUMMARY

It is an object of the present invention to provide an improved method of driving a bistable electro-optic display.

It is a further object of the present invention to provide an improved apparatus for driving an electro-optic display.

It is a further object of the present invention to provide an improved system comprising an electro-optic display and an improved apparatus for driving the electro-optic display.

According to a first aspect of the present invention an apparatus for driving a bistable electro-optic display is provided as claimed in claim 1.

According to a second aspect of the present invention a system comprising a bistable electro-optic display and an apparatus for driving said display is provided as claimed in claim 6.

According to a third aspect of the present invention a method for driving a bistable electro-optic display is provided as claimed in claim 9.

In practice a bistable display has a plurality of pixels. It is desirable that the pixels are settable in a plurality of states corresponding to a respective luminance, comprising a first state with a first luminance, a second state with a second luminance and a plurality of intermediate states having respective intermediate luminances, said intermediate luminances forming a partition of a dynamic range between the first luminance and the second luminance.

The method as claimed in claim 1 makes it possible to achieve a finer distribution of luminances, without necessitating addition voltage levels to drive the display or necessitating a higher frame rate.

It is recognized by the inventors that the resulting luminance change does not only depend on the number of pulses applied and the voltage of these pulses, but that this also depends on the sequence in which these pulses are applied.

Accordingly, a finer distribution of luminances is achieved by applying voltage sequences in which the same number of voltage pulses occur, but in a different order. I.e., different permutations of a basis voltage sequence are used. The basis voltage sequence may have a length K in the range of 4 to 10 voltage pulses.

It will be appreciated that the term "equidistant partition of the dynamic range" may relate not to a physically equal partition, but to an equidistant partition as perceived by a human eye. It will be appreciated that for this purpose a known human eye sensitivity curve may be used for defining said partition. It is recognized in the art that reflectance (R) is proportional to power and expressed in $Cd/m^2$. The reflectance can be measured as a function of the wavelength of the light. The average reflectance between a wavelength of 350 nm and 780 nm is defined as the total reflectance of the visible light. The relative reflectance is expressed in percent (%) with respect to a reference (white for example). Luminance (Y) is the light sensitivity of human vision in $Cd/m^2$. It is derived from reflectance as a function of the wavelength by a convolution with the eye sensitivity curve. The average value is the total luminance of the visible light. The relative luminance is expressed in percent (%) and is the luminance with respect to a reference (white for example). Lightness (L*) is the perceptual response to the relative luminance in percent (%). L* has the usual ICE definition:

$$L^* = 116\left(\frac{R}{Ro}\right)^{1/3} - 16$$

Therein R is the reflectance and Ro is a standard reflectance value.

A delta L* of unity is taken to be roughly the threshold of visibility. Grey levels in a display are preferably generated equidistant with respect to lightness L*.

It is noted that the bistable or multi-stable behavior of particle-based electrophoretic displays, and other electro-optic displays displaying similar behavior, is in marked contrast to that of conventional liquid crystal ("LC") displays. Twisted nematic liquid crystals act not bi- or multi-stable but act as voltage transducers, so that applying a given electric field to a pixel of such a display produces a specific luminance at the pixel, regardless of the luminance previously present at the pixel. Furthermore, LC displays are only driven in one direction (from non-transmissive or "dark" to transmissive or "light"), the reverse transition from a lighter state to a darker one being effected by reducing or eliminating the electric field. Finally, the luminance of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

Bistable displays are favorable in view of their low energy consumption, as energy is only required to change, and not to maintain, the display content. This advantage is in particular important for displays in portable applications. In particular for such applications it is attractive that the display is flexible so that it can also be stored compactly.

The present state of a pixel in a bistable display depends in practice not only on the most recent voltage sequence used to control the pixel but also on the previous voltage sequences applied to the pixel. This makes it difficult to predict the present state.

Accordingly, in an embodiment, the sequence comprises a first and a second subsequence, the second subsequence following the first subsequence, wherein the first subsequence has the effect that the at least one pixel is reset to a reset state having a reset luminance, and wherein the second subsequence causes a state transition of said pixel from the reset state to a state having the desired luminance. The first and the second subsequence will also be denoted as the reset subsequence and the set subsequence respectively.

Applying the reset subsequence resets the at least one pixel to a predetermined reset state, so that the effect of voltage sequences before said first voltage sequence is reduced.

It is most practical to select as the reset state a state having a reset luminance equal to the first or the second luminance. In that case the reset state is an extreme state, which can be more reliably achieved than an intermediate state.

According to a first approach the reset state may be achieved by applying a single reset pulse of proper polarity and duration independent of the present state.

According to a second approach the reset subsequence depends on an estimated value of the present state. In this way the effect of driving history can be erased more efficiently. I.e., the history can be erased better and/or in a shorter time. According to this approach the reset subsequence comprises a first and a second reset sequence portion. In the first reset sequence portion the luminance of the at least one pixel is increased if the estimated present luminance is more than a first threshold lower than an intermediary value and the luminance is decreased if the estimated present luminance is more than a second threshold higher than the intermediary value. In the second reset sequence portion the luminance of the pixel is controlled towards the reset state independent of the present state.

The present state herein is the state of the pixel before the start of the reset subsequence.

In the second approach it can be observed that the luminance of the pixel is first controlled towards an intermediary value. If the present state is a state having a relatively low luminance, then the luminance will first be increased during the first reset sequence portion to achieve said intermediary value. If the present state is a state having a relatively high luminance the luminance will first be decreased during the first reset sequence portion to achieve said intermediary value. In the second reset sequence portion the pixel is controlled towards the reset state independent of the present state.

Usually the exact luminance for a pixel is not known, unless the luminance is sensed. However, if the pixels are regularly reset to a reset state, the present luminance can be reliably estimated on the basis of the known behavior of the pixels and the applied voltage sequence.

Depending on the type of pixel driver the first reset sequence portion may be carried out simultaneously for all pixels, or during separate driving stages for the pixels having the relatively low estimated luminance and for the pixels having the relatively high estimated luminance.

Although the highest image quality is obtained if the display is first reset to a well defined reset state, it may alternatively be desired to achieve a reasonable quality in an update period of modest duration. This may be achieved in a direct update mode according to an embodiment of the invention, wherein the sequence exclusively comprises a set sequence, i.e. a reset phase is absent in the sequence. Also in this embodiment a portion of the applied sequence is selected from a plurality of mutually different sequence portions, wherein at least a first and a second of this plurality of sequence portions mutually have the same number of voltage levels occurring the same number of times, but have said voltage levels occur in a mutually different order. Accordingly, despite the fact that the sequence can be short, a relatively precise differentiation can be achieved in the obtained grayvalues.

The direct update mode may be alternated with the other described mode, also denoted as indirect update mode, wherein the set sequence is preceded by a reset sequence. For example each predetermined number, e.g. 4, of direct updates may be followed by an indirect update.

In an embodiment the set subsequence comprises a first, preparatory set sequence portion that results in a transition of the previous state, e.g. the reset state having the reset luminance to a preparatory intermediary value (P1, P2) and a second, final set sequence portion, following the preparatory set sequence portion and that results in a transition of the luminance from said preparatory intermediary value to said desired value.

In an embodiment the preparatory set sequence portion is the portion of the sequence that is selected from the plurality of mutually different sequence portions, to achieve mutually different luminance transitions.

In the preparatory set sequence portion the luminance typically changes monotonically from the reset luminance towards an intermediary value. Due to the fact that the preparatory set sequence portion is selected from a plurality of mutually different sequence portions, mutually different luminance transitions are achieved. The differences between the luminance transitions are relative small, due to the fact that the integral of the voltage over the time interval of these sequence portions is the same and that the number of voltage pulses having the same value is the same. Only the order in which the voltage pulses in the preparatory set sequence portion is applied differs. The preparatory set sequence portion is followed by the final set sequence portion, wherein the luminance is controlled to achieve the desired luminance. During the final set sequence portion, pixels that have a relatively small luminance difference after completion of the preparatory set sequence portion may have a relatively large luminance difference after completion of the final set sequence portion. In essence, in this way a fine tuning phase is implemented before a course tuning phase.

BRIEF DESCRIPTION OF THE DRAWINGS

These and other aspects are described in more detail with reference to the drawing wherein.

DETAILED DESCRIPTION OF EMBODIMENTS

In the following detailed description numerous specific details are set forth in order to provide a thorough understanding of the present invention. However, it will be understood by one skilled in the art that the present invention may be practiced without these specific details. In other instances, well known methods, procedures, and components have not been described in detail so as not to obscure aspects of the present invention.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes and sizes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element or layer is referred to as being "coupled to" another element or layer, it can be directly on, connected or coupled to the other element or layer or intervening elements or layers may be present. In contrast, when an element is referred to as being "connected to" another element or layer, there are no intervening elements or layers present. Like numbers refer to like elements throughout. As used herein, the term "and/or" includes any and all combinations of one or more of the associated listed items.

Figure 1:
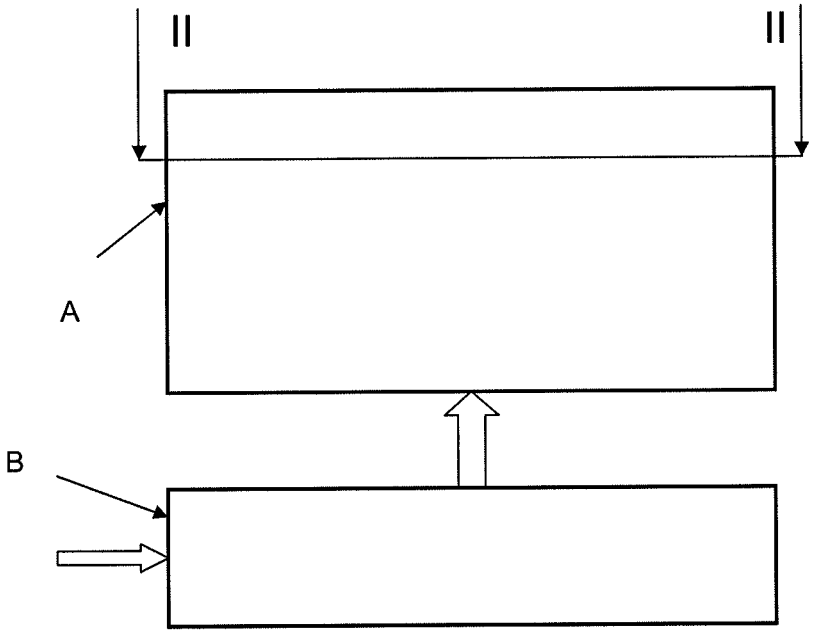
FIG. 1 schematically shows a system comprising a bistable display and an apparatus for driving the display, FIG. 2 schematically shows a portion of a display in a cross-section according to II-II in FIG. 1, FIG. 3 schematically shows a circuit drawing of an apparatus B for driving the display A, FIG. 3*a* schematically shows a change in reflection of a pixel as a function of time when applying a constant control voltage over the pixel electrodes.

FIG. 1 schematically shows a system comprising a bistable display A and an apparatus B for driving the display A. The display has a plurality of pixels settable in a plurality of luminance levels comprising a first level, a second level and a plurality of intermediate levels. The intermediate levels form a substantially equidistant partition of a dynamic range between the first level and the second level.

Figure 2:
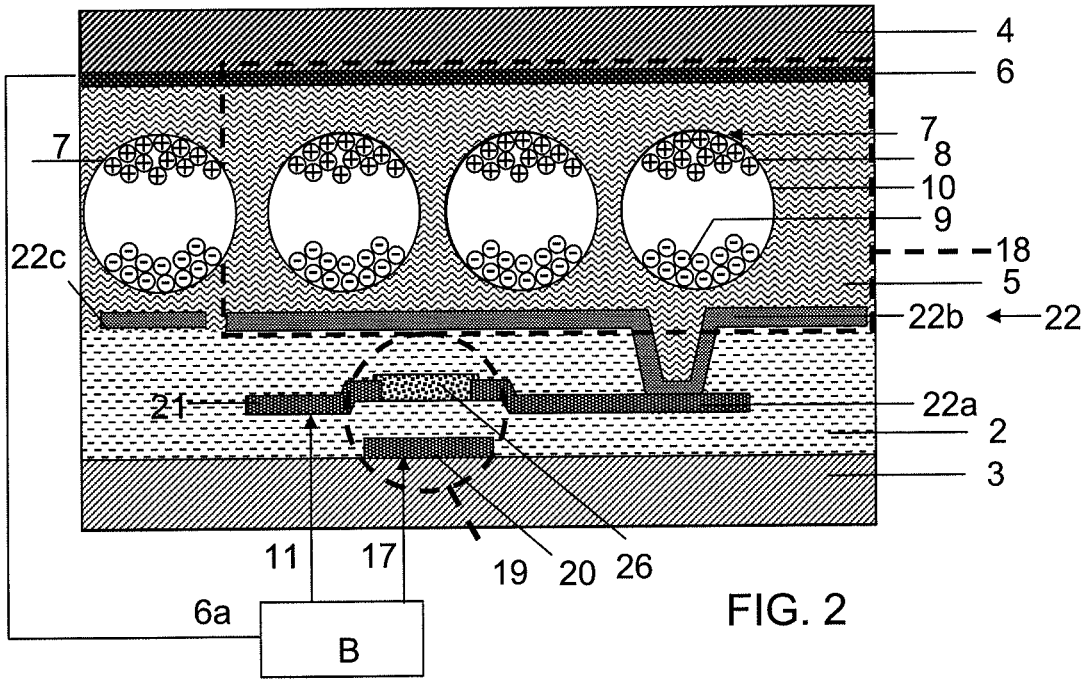

FIG. 2 schematically shows a portion of the display in a cross-section according to II-II in FIG. 1 and schematically shows the apparatus B coupled by lines 6*a*, 11 and 17 to the display (display A in FIG. 1).

In the embodiment shown in FIGS. 1 and 2, the display A is an active matrix display. As shown in FIG. 2 the cross-section of display A comprises an electrophoretic medium 5 having embedded electrophoretic display elements 7 between a common electrode 6 on top substrate 4 and electrode 22 on substrate 3 provided with active switching elements in a dielectric medium 2. For clarity FIG. 2 only shows a single switching element 19 and an associated pixel 18. In practice however the display A may have a plurality of switching elements arranged in a matrix comprising several hundreds to several thousands of rows and several hundreds to several thousands of columns. The active switching element 19 is a thin film transistor (TFT) with a gate electrode 20, a semiconducting channel 26, a source electrode 21 and a drain electrode 22*a* that is electrically coupled to a pixel electrode 22*b* of the associated pixel 18. The pixel 18 controlled by the active switching element 19 comprises a set of display elements in the form of microcapsules 7 embedded in the medium 5. Preferably, a counter electrode 6 is provided on the film comprising the encapsulated electrophoretic ink, but a counter electrode could be alternatively provided too on the base substrate in the case of operation with in-plane electric fields.

The set of display elements 7 may comprise one or more display elements. The electrophoretic medium with the embedded electrophoretic display elements 7 is arranged between a first electrode layer 22 and a second electrode layer 6. At least one of the electrode layers 6, 22, here the first electrode layer 22, has a plurality of mutually separate electrode portions 22*b*, 22*c*. In the embodiment shown, the display elements 7 are formed by microcapsules that comprise a dispersion of positively charged white nano-particles 8 and negatively charged black nano-particles 9 in a clear solution 10. In other embodiments the display comprises particles of a single type.

The medium 5 is, by way of example, a transparent polymeric material that may be cured (i.e., cross-linked from a low-viscosity state into extremely high viscosity) or otherwise solidified at relatively low temperatures, and which readily accepts, in its low-viscosity state, a dispersion of microcapsules. Useful materials include polyvinyl alcohols, gelatins, epoxies and other resins.

Figure 3:
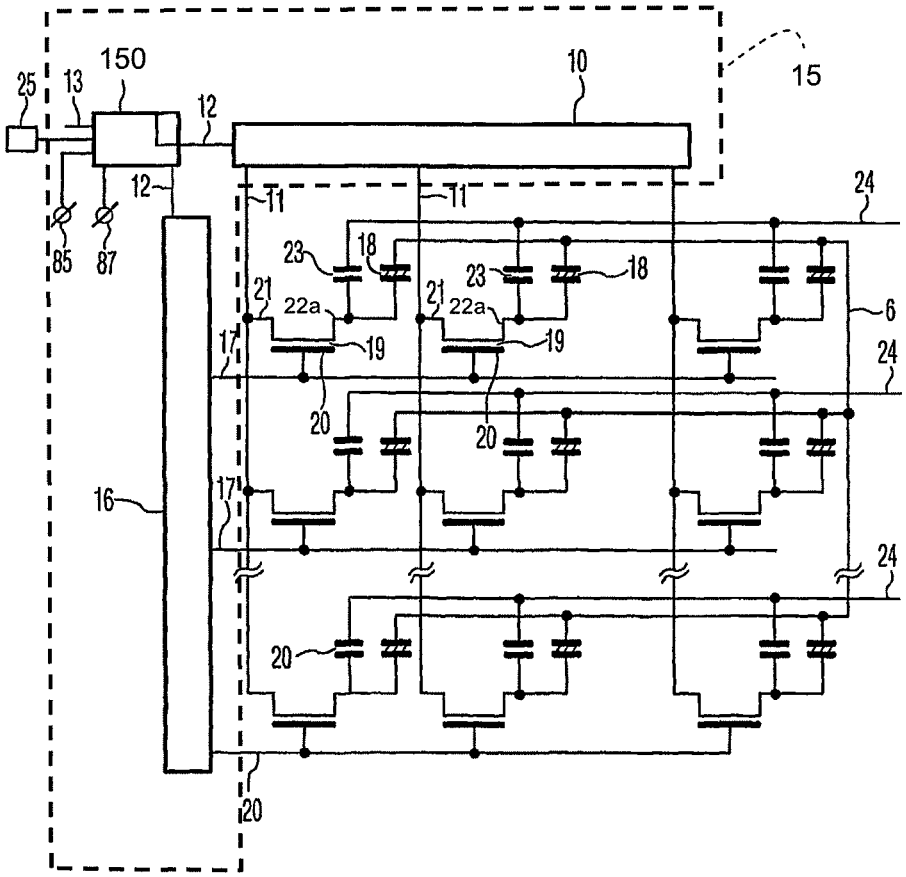

FIG. 3 schematically shows an apparatus B for driving the display A (see FIG. 1). As shown in FIG. 3, the apparatus B comprises a driver 15 for driving the active switching elements 19 that comprises a row driver 16 and a column driver 10 and a processor 150 that controls the row and column driver 16, 10. The display A comprises a matrix of display elements at the area of crossings of row or selection electrodes 17 and column or data electrodes 11. The row driver 16 consecutively selects the row electrodes 17, while a column driver 10 provides a data signal to the column electrodes 11. The processor 150 has an input facility 13 for receiving input data. The processor 150 may process the incoming data, for example to compensate for temperature variations, using input from a temperature sensor unit 25. Counter electrodes may be coupled to two outputs 85, 87 of the processor 150. Mutual synchronization between the column driver 10 and the row driver 16 takes place via drive lines 12. Select signals from the row driver 16 select the pixel electrodes 22*b* (FIG. 2) via drain 22*a* of the thin-film transistors 19 whose gate electrodes 20 are electrically connected to the row electrodes 17 and the source electrodes 21 are electrically connected to the column electrodes 11. A data signal present at the column electrode 11 is transferred to the pixel electrode 22*b* of the display element coupled to the drain electrode 22*a* via the TFT. The data signal results in a charge current $I_d$ (see FIG. 10). In the embodiment shown, the display device of FIG. 1 also comprises an additional capacitor 23 at the location of each display element 18. In this embodiment, the additional capacitor 23 is connected to one or more storage capacitor lines 24. Instead of TFT's, other switching elements can be used, such as diodes, MIM's, etc.

Active matrix driving is done by scanning all rows during a frame. The frame time is divided into n equal line times, where n is the number of rows in the display. Starting with row 1, ending with row n, each line is selected and the switch TFT is opened and the data written on the columns is transferred to the pixel. In the line time the pixel capacitance is charged. The storage capacitor 23, a capacitor between the pixel and a separate grid of storage lines, is the main constituent of the pixel capacitance. During the hold time, the time that the switch TFT is closed, the written data voltage should remain on the pixel. The voltage difference between the common plate and the pixel ΔVep drives the electrophoretic display effect. A frame is typically 20 ms long (50 Hz refresh).

In order to change image content on the display, new image information is written for a certain amount of time. Dependent on the required quality, the image information writing time may be in a range of 0.2 to 1 s, for example. The refresh rate of the active-matrix is usually higher (for example 20 ms frame time for a 50 Hz display and 10 ms frame time for a 100 Hz display). Changing pixels of such display from black to white, for example, requires the pixel capacitors to be charged to a suitable control voltage for 200 ms to 500 ms, in the case where a pulse-width modulation principle is used. During this time the white particles drift towards the top (common) electrode, while the black particles drift towards the bottom electrode, for example an active-matrix back plane. Switching to black requires a control voltage of a different polarity, and applying substantially 0 V on the pixel substantially preserves its condition. Addressing such electrophoretic display for a short time with a certain voltage will result in a situation that a mixture of white and black particles is visible.

Figure 3A:
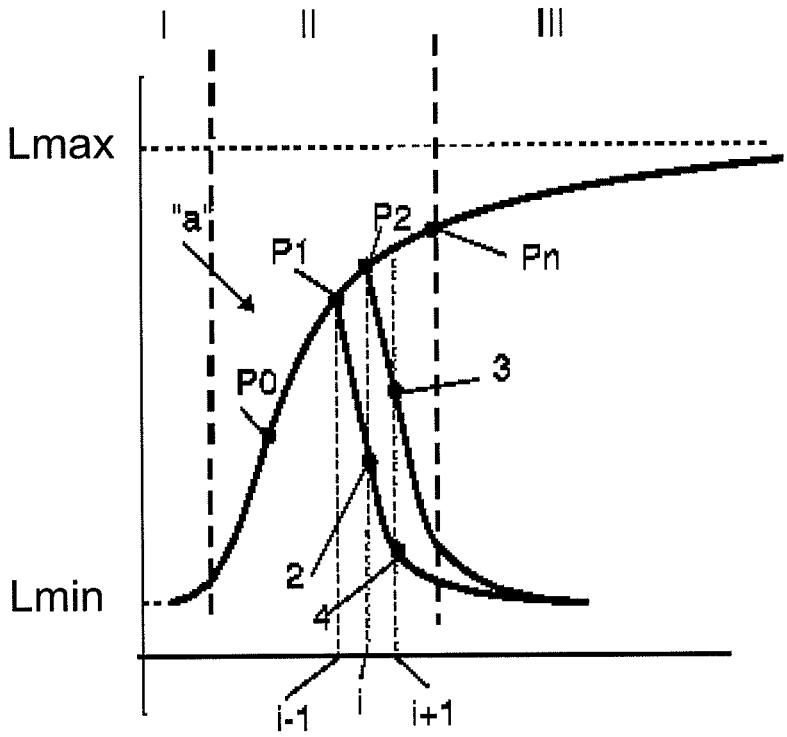

In FIG. 3*a* curve "a" schematically illustrates how the reflection of a pixel changes from a minimum value Lmin to a maximum value Lmax when a constant control voltage is applied over the pixel electrodes. The horizontal axis indicates the time in terms of frame numbers i−1, i, i+1.

A reflection curve "a" has three identifiable regions. Initially, in a region I, a relatively slow change of the reflection occurs, i.e. low derivative. After a certain percentage of the reflection is reached in region II, a change in reflection per applied voltage (abscissa) may have a steep portion, characterized by an increased derivative. Finally, in region III close to the maximum reflection level Lmax, a change in reflection may decrease again, i.e. lower derivative. Likewise the curve indicating the transition from a maximum value Lmax of the reflection to a minimum value Lmin by application of a control voltage of opposite polarity subsequently has a first phase I, a second phase II and a third phase III, having a relative low derivative, a relatively high derivative and a relatively low derivative respectively.

Figure 4:
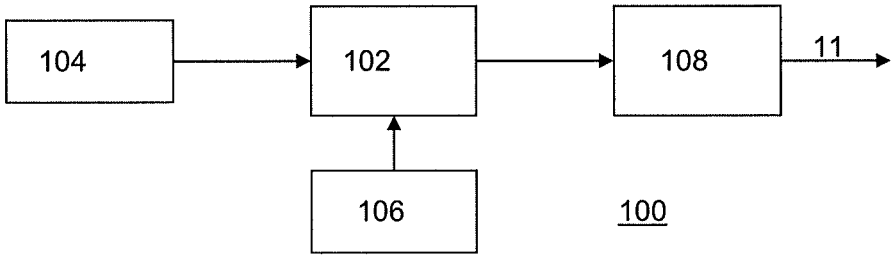
FIG. 4 shows a first embodiment of an apparatus according to the first aspect of the present invention, FIG. 5 schematically shows a lookup table for use in the apparatus of FIG. 4.

FIG. 4 schematically shows, by way of example, a control circuit 100 of the column driver 10 (FIG. 3) responsible for driving a single column 11. In a typical embodiment the column driver 10 has a control circuit 100 for each of the columns 11. However, alternatively, the column circuitry or parts thereof may be time-shared between different columns.

The control circuit 100 comprises a lookup table 102 storing, for each desired luminance of a pixel, an indication for a sequence of pulses necessary to achieve the desired luminance. The table 102 may, for example, indicate for each of the pulses in the sequence the desired value of the voltage to be applied to the column 11. Alternatively it is conceivable that run length encoding is applied. The desired $L^d$ and current luminance $L^c$ may be stored in a register 104 that provides an input address for the lookup-table 102. The control circuit 100 has a counter 106 that counts subsequent frames and selects the relevant time-slot from the lookup-table 102. The driver 108 generates the desired voltage based on the indication specified in the selected time-slot for the desired luminance. Instead of using a lookup table 102 for storing the pulse sequences the control circuit may for example use a polynomial function to calculate voltage level of subsequent pulses.

Figure 5:
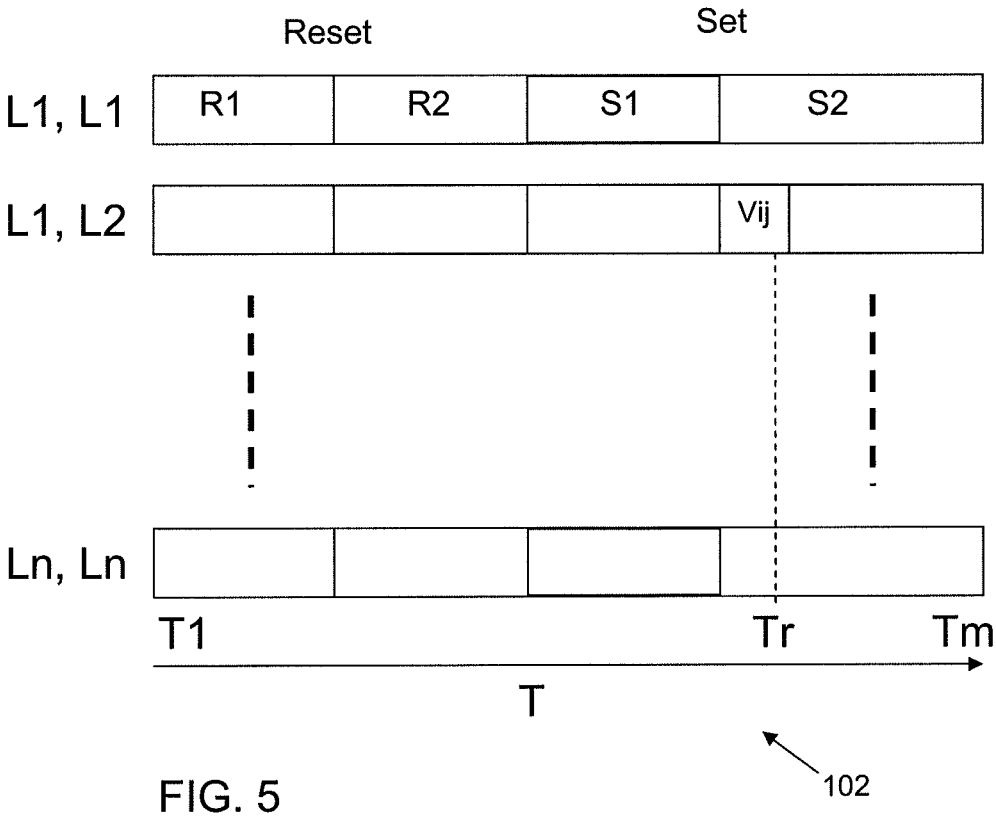
FIG. 5A shows an alternative lookup table in another exemplary embodiment.
FIG. 5B shows a further lookup table in the alternative embodiment of a lookup table depicted in FIG. 5A, FIG. 6 illustratively depicts various signals applied in an embodiment of an apparatus according to the first aspect of the invention, and their effect on the luminance of a pixel of a display controlled by the sequence, FIG. 7 schematically shows how a luminance of a pixel is controlled from a reset value to a desired value by control sequence.

FIG. 5 shows a portion in the lookup-table 102 in more detail. In the embodiment shown, the table comprises data indicative for respective pulse sequences corresponding to each possible combination of desired luminance $L^d$ and current luminance $L^c$ L1, L1; L1, L2; . . . Ln, L1; Ln, L2, Ln, Ln. In certain embodiments the entries for combinations having a desired luminance corresponding to the current luminance are superfluous. Each entry in the table specifies a voltage Vij to be applied at time slot Tj to achieve the desired luminance, starting from the current Luminance after completion of the pulse sequence. The time slots correspond to a frame time, e.g. 20 ms. For example Vij=V2*r* is the voltage to be applied at the time-slot Tj=Tr to achieve luminance level L2, starting from luminance level L1, after completion of the sequence. In the embodiment shown, the specified sequence of pulses comprises a first subsequence (Reset sequence) having the effect that the luminance of the pixel is reset to a predetermined extreme value, e.g., white or black. The specified sequence of pulses has a second subsequence (Set sequence), following the first portion, and having the effect that the luminance of the pixel is set to a desired value.

The reset subsequence has a first reset subsequence portion R1 and a second reset subsequence portion R2. The set subsequence has a first set subsequence portion S1, also denoted preparatory portion and a second set subsequence portion S2, also denoted as final portion.

In particular the first, preparatory portion S1 of the set subsequence has the effect that the luminance level is brought to a preparatory intermediate level (e.g. P0, P1, P2 on Pn) high up the steep portion II of the switching curve shown in FIG. 3*a*). From that intermediate level lower grey levels are reached by biasing the electrophoretic display effect towards black by application of the second, final portion S2 of the set subsequence, e.g. according to curves 2, 3 in FIG. 3*a*. Higher grey levels are reached by biasing the electrophoretic display effect towards white by application of S2, e.g., therewith further following curve a. This methodology results in a robust driving scheme. In a typical embodiment the preparatory intermediate level is in the order of ⅔ of the maximum luminance level. For example, if the display has 32 luminance levels, 0-31, the preparatory intermediate level is selected close to (grey-intermediate) luminance level 20.

The set subsequence has a second portion, following the preparatory portion, that serves to modify the luminance of the pixel from the preparatory intermediate level to the desired luminance level. For a typical electrophoretic display the total duration T of the set sequence is, for example, 250 ms. The duration of the final portion of the sequence is, for example, 120 ms.

Figure 5A:
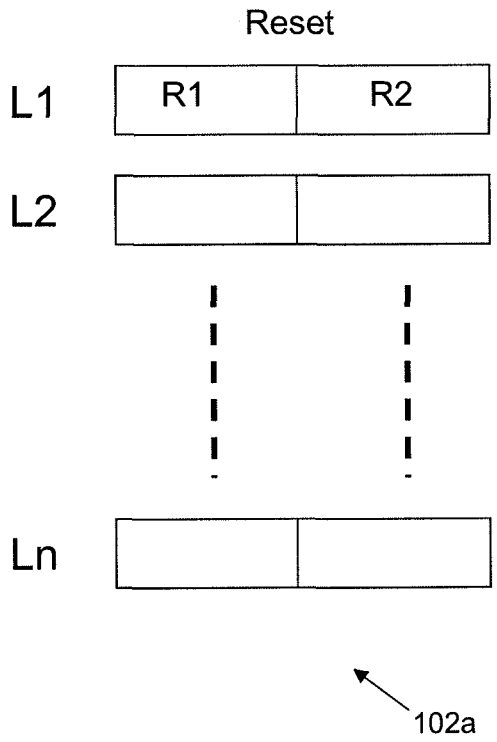
Figure 5B:
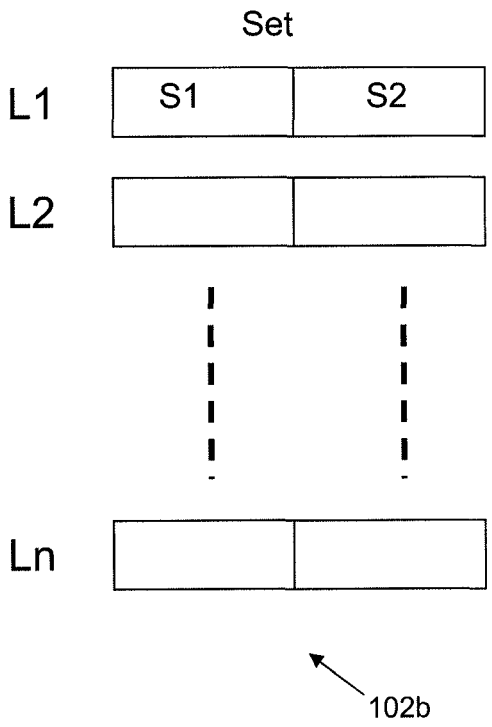

In practice the lookup table, as illustrated in FIG. 5, may have a large number of entries, e.g., about 900 in case of 32 luminance levels. In another embodiment the device has separate lookup tables 102*a*, 102*b* for the reset phase and the set phase as schematically shown in FIG. 5A, 5B. The sequence to be applied is composed from a reset sequence read from the first lookup table 102*a* and a set sequence read from the second lookup table 102*b*. The first lookup table 102*a* is indexed by the current grey value and the second lookup table 102*b* is indexed by the desired grey value stored in register 104. In this embodiment only 2n entries are necessary wherein n is the number of gray values.

In the case of a direct update, as described above, a reset phase is absent. In practice the achievable luminance resolution in the case of a direct update is lower than in the case of an indirect update, also denoted as quality update. For example 4 or 8 luminance levels may be achieved. In this case it may be considered to store a set of entries for each combination of current luminance level and desired luminance level in a single lookup table.

Figure 6:
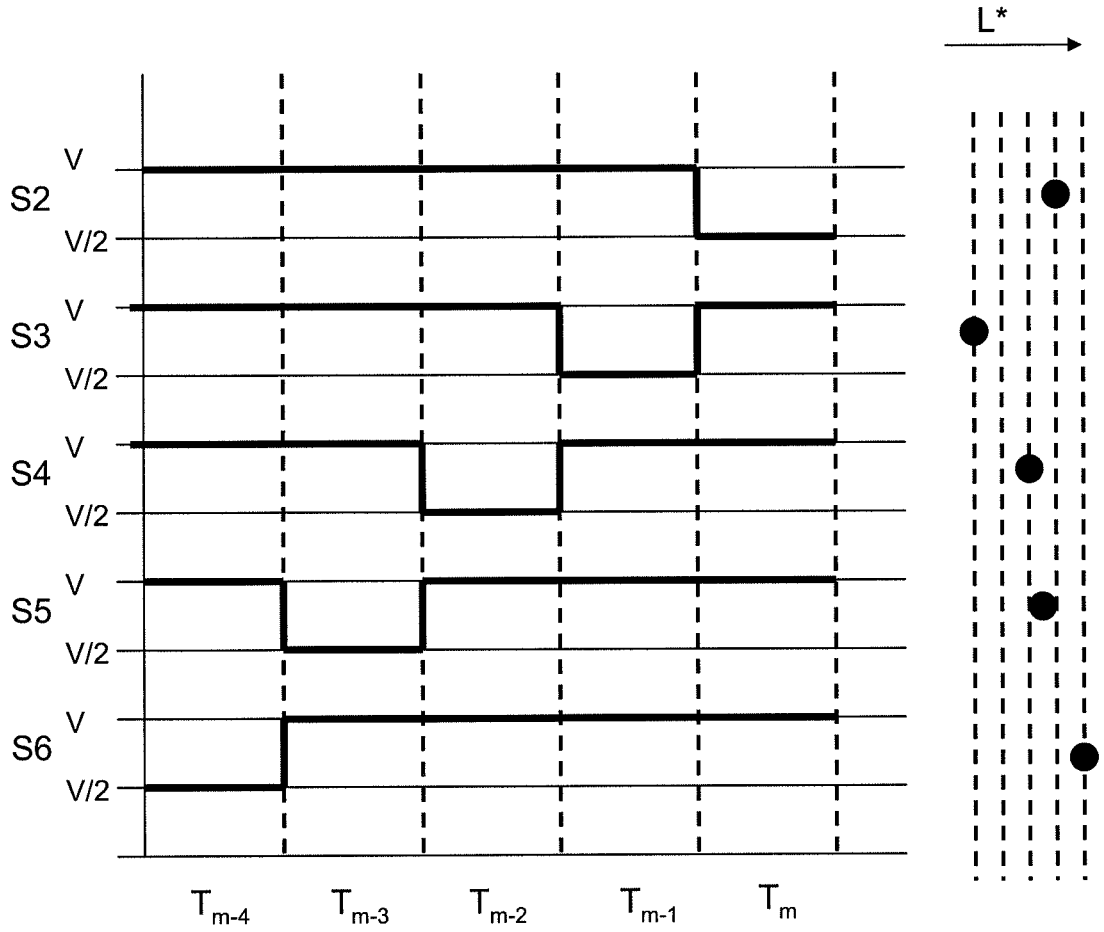

FIG. 6 shows, on the left side, some examples of preparatory portions S2, . . . S6 of the control sequence. Therein the voltages of the pulses in the sequence are shown for the five frames $T_{m-4}$ to $T_m$. These preparatory set sequence portions mutually have the same number of voltage levels occurring the same number of times, but have said voltage levels occur in a mutually different order. In the embodiment shown, the tune portions comprise a pulse sequence having a length K modulating between V/2 and V, wherein V is the maximum applicable voltage. K is a predetermined number in the range of 4 to 10, in this case 5. Each tune portion comprises K−1 pulses of value V and 1 pulse with value V/2 in a different order. Accordingly the voltage levels of these tune portions are selected from the same set {V, V/2} and the voltage levels selected from that set occur the same number of times in each of the tune portions, but in a different order for each of the tune portions. Setting the absolute value of the voltage level during K−1 of the intervals to an extreme value results in a rapid transition of the luminance, while allowing for a fine-tuning of the result of said transition close to the desired luminance value.

On the right side, FIG. 6 shows the luminance L* achieved after completion of the tune portion of the sequence. The dotted lines are separated by 0.2 on the L* scale. In an embodiment, the tune portions S3, S4 and S6 are used to obtain luminances that respectively differ by 0.4 on the L* scale.

A similar result can be obtained by using a pulse sequence modulating between 0 and V (i.e. shifting one frame with value 0 through the sequence) or using a pulse sequence modulating between −V and V (i.e. shifting one frame with value −V through the sequence; in this case the preparatory portion of the set sequence is not strictly monotonic, although this will typically not be observed by the user). Even more possibilities arise when K−2 pulses of value V are permuted with 2 pulses with different values.

Figure 7:
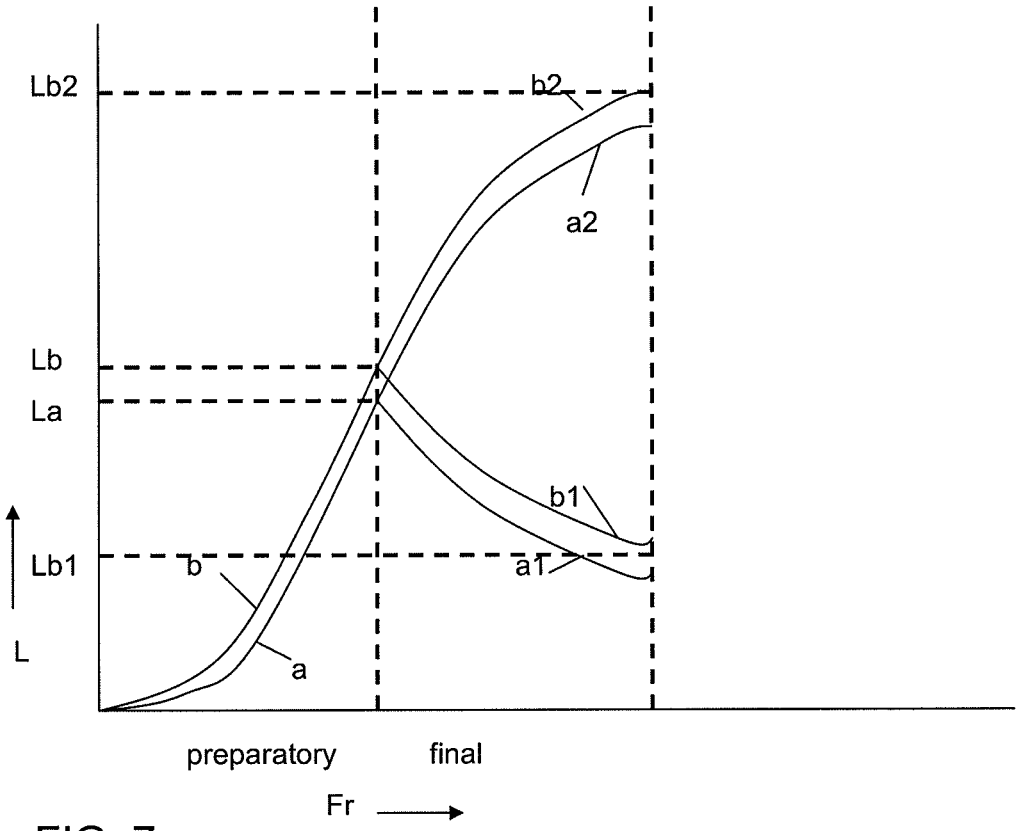

The first, preparatory, set subsequence is followed by a final subsequence wherein the luminance values of the pixels are controlled towards the desired luminance. After application of the final subsequence pixels that have a relatively small luminance difference may obtain a relatively high luminance difference. For example FIG. 7 illustrates a first and a second luminance change, indicated as curves a, b induced respectively by preparatory set sequences S4 and S6. In FIG. 7 the luminance L is indicated as a function of the frame number Fr. A relatively small luminance difference Lb−La is achieved after application of the preparatory set sequences S4 and S6 of FIG. 6, due to the fact that the preparatory set sequence portions S4, S6 mutually have the same number of voltage levels occurring the same number of times, but have said voltage levels occur in a mutually different order.

During the final set stage, a relatively large luminance difference is obtained. For example a first pixel having obtained preparatory intermediate luminance Lb may be further controlled to obtain a desired luminance Lb1 via curve b1, while another pixel with intermediate luminance Lb may be controlled during the final set sequence portion to obtain an desired luminance Lb2 via curve b2. Likewise starting from intermediate luminance level La substantially differs final luminance levels are obtained according to curve a1, a2. I.e. after completion of the final set subsequence portion a substantially increased luminance distribution is obtained, i.e. the variance introduced in the distribution of luminancies caused by the final set subsequence and starting from the same preparatory intermediate value is at least twice, typically at least five times as large as the variance in the preparatory intermediate values.

In an embodiment of a device according to the invention, the reset sequence applied to the pixels is dependent on the estimated value of the luminance of the pixels. The estimated value used is typically the luminance that the pixels are expected to have on the basis of the response of the pixels to the drive sequence applied thereto.

According to this embodiment, illustrated with reference to FIG. 8, the reset sequence has a first reset sequence portion RP1*a*, RP1*b* and a second reset sequence portion RP2. In the first reset sequence portion RP1*a*, RP1*b* the luminance of the at least one pixel is increased if the estimated present luminance is more than a first threshold lower than an intermediary value and the luminance is decreased if the estimated present luminance is more than a second threshold higher than the intermediary value. By way of example the pixels may have 32 luminance values, the first intermediary value is 14 and the first and the second threshold is 1. In the second reset sequence portion RP2 the luminance of the pixel is controlled towards the reset state independent of the present state.

In an embodiment the second reset subsequence portion is selected from a plurality of mutually different sequence portions, to achieve mutually different luminance transitions, wherein at least a first and a second of this plurality of sequence portions mutually have a same set of voltage levels. The voltage levels from that set occurring the same number of times in both the first and the second sequence portion, but in a mutually different order. The selection from a plurality of mutually different sequence portions that have the same number of voltage levels occurring the same number of times, but in a different order, makes it possible to fine tune the reset procedure so that image history is further reduced.

Figure 8:
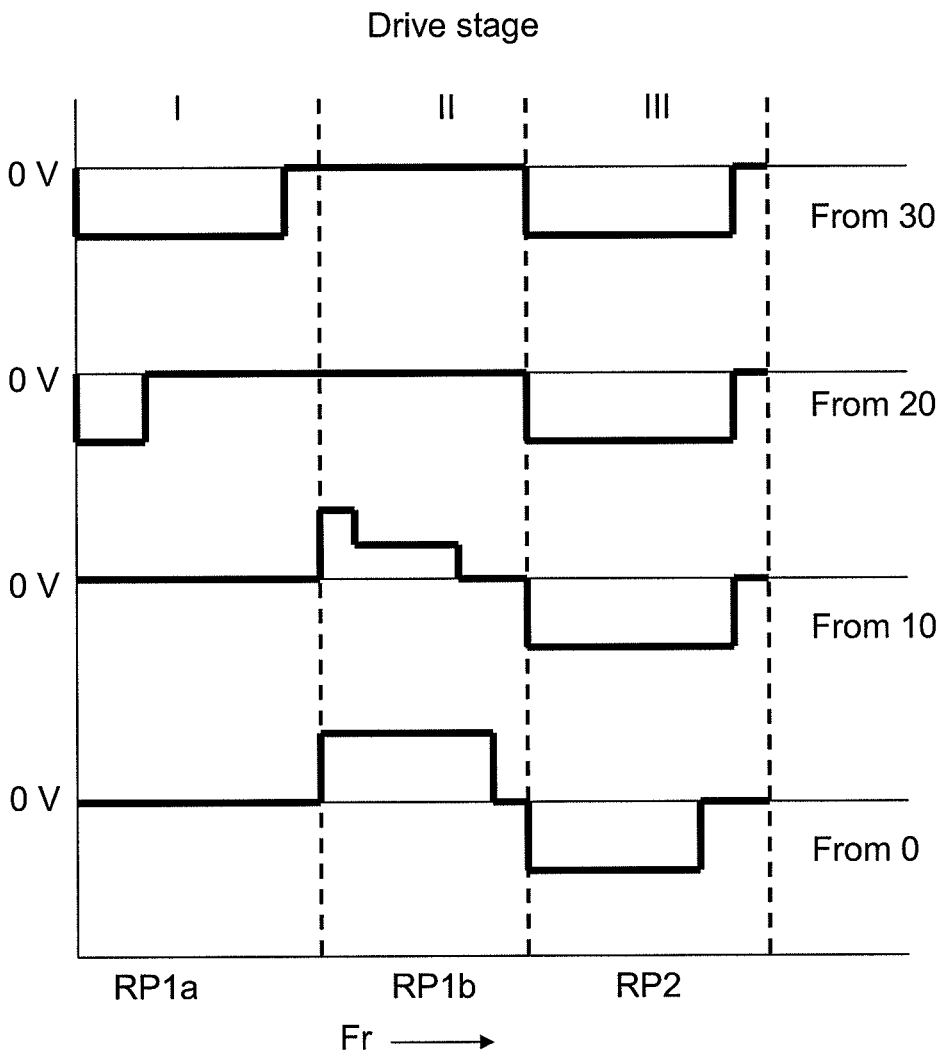
FIG. 8 shows examples of reset sequences, FIG. 9 schematically shows a second embodiment of an apparatus according to the first aspect of the present invention, FIG. 10 schematically shows a third embodiment of an apparatus according to the first aspect of the present invention, and FIG. 11 schematically illustrates a method of operation of the apparatus of FIG. 10.

FIG. 8 shows a typical example. The first reset sequence is used to reset a pixel having pixel value 30. During a first drive stage I the first reset sequence portion RP1*a* is applied for the pixels having the relatively high luminance. During a second drive stage II the pixel no driving voltage (V=0) is applied. During a third drive stage III the second reset sequence is applied to the pixel.

As another example the lower curve shows the reset sequence applied to a pixel having estimated luminance value 0. During the first drive stage I no driving voltage (V=0) is applied.

In the example of FIG. 8 it is presumed that the driver uses a drive scheme wherein positive and negative pixel drive voltages are applied during separate drive stages. In this case the first reset sequence portion RP1*a* is applied during a first drive stage for the pixels having the relatively high luminance and the first reset sequence portion RP1*b* is applied during a second drive stage for the pixels having the relatively low luminance. In other embodiments the first reset sequence portions RP1*a*, RP1*b* are applied simultaneously to the pixels having the relatively high luminance and the pixels having the relatively low luminance respectively.

Figure 9:
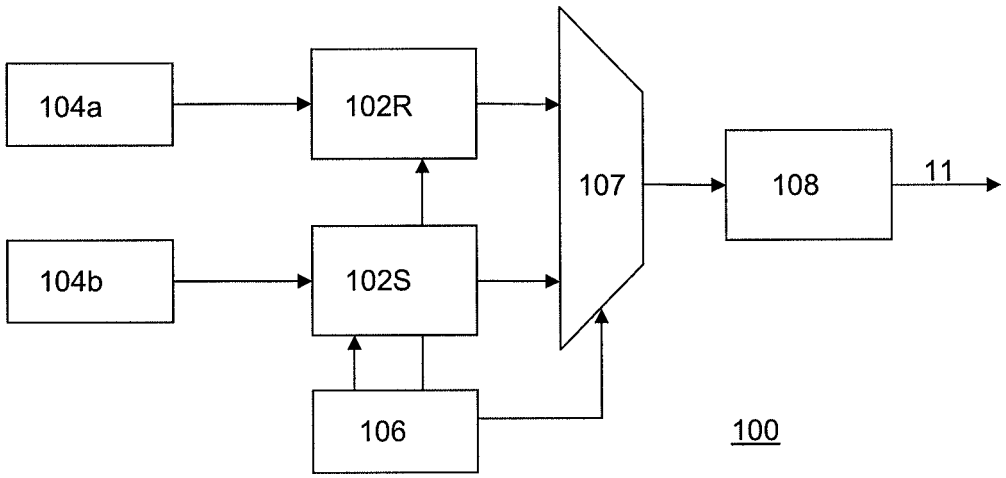

If separate reset subsequences are applied to the pixels dependent on their present state, i.e., their luminance, it is favorable to have separate lookup tables for indicating the reset subsequence for resetting the pixel state from the present state to the reset state and for indicating the set subsequence for setting the pixel from the reset state to the desired state, as is illustrated in FIG. 9. In this case the number of storage locations for the lookup table entries is reduced from N×N to 2×N, N being the number of luminances.

In the embodiment of FIG. 9 the device 100 has a first register 104*a* containing an indication for the present state, i.e. the present luminance of the pixel. A second register 104*b* contains an indication for the desired state, i.e. the desired luminance of the pixels. The device 100 has a first and a second lookup table 102R and 102S respectively. The first lookup table 102R comprises an indication for the desired reset sequence for achieving the reset state dependent on the present state. The second lookup table 102S comprises an indication for the desired set sequence for achieving the desired state starting from the reset state.

During a first time frame the counter 106 controls the selection element 107 to select the output of the first lookup table 102R to be provided as the input signal to the driver 108 and the counter 106 addresses subsequent locations in the first lookup table 102R to obtain the reset subsequence. During a second time frame following the first time frame the counter 106 controls the selection element 107 to select the output of the second lookup table 102S to be provided as the input signal to the driver 108 and the counter 106 addresses subsequent locations in the second lookup table 102S to obtain the set subsequence.

In the embodiments described above only the column driver is controlled to obtain the desired variations in the voltage level across the pixel electrodes. In another embodiment, as described in EP2095357, the desired sequence of voltages is applied by controlling both the column driver and a common voltage driver.

Figure 10:
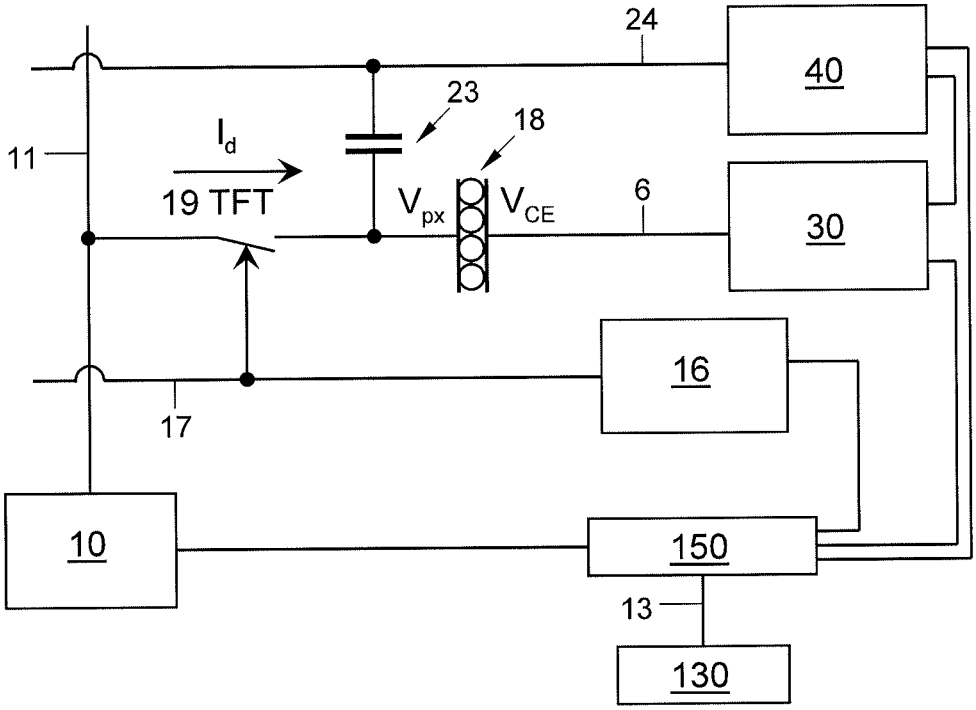

FIG. 10 shows an alternative embodiment for the apparatus for driving the display wherein both the column driver and a common voltage driver are controlled to achieve a resultant control voltage over the display elements 18. For clarity only a single display element itself is shown.

In the embodiment shown in FIG. 10, the apparatus has an additional driver 30 for driving the common electrodes 6 (see also FIG. 2) of the pixels. The apparatus in addition has a capacitor line driver 40. In this embodiment it is possible to select the voltage difference Vpx over the electrodes of the pixel from N.M different voltages, by combining a column driver 10 capable of providing N different voltage levels and a common driver 30 capable of providing M different voltage levels. The controller 150 obtains its image data at an input 13 from memory 130.

Figure 11:
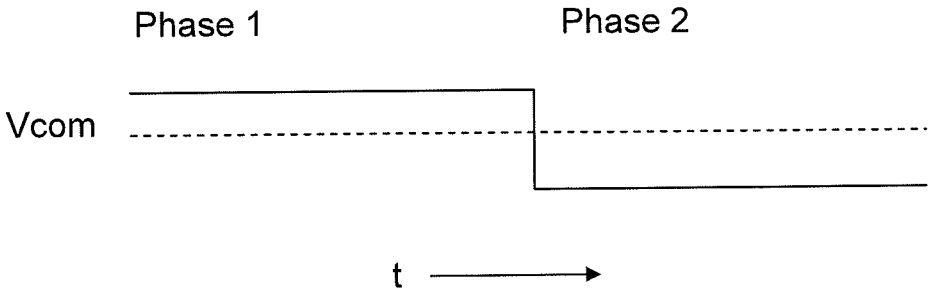

In a practical embodiment the display is updated in a first and a second phase as schematically shown in FIG. 11. In the first phase the common voltage Vcom is set to a first level, e.g., V, and in the second phase the common voltage is set to a second level, e.g. −V. During the first phase the column driver 10 is controlled to achieve all luminance transitions that require a negative voltage difference over the display element 18 and during the second phase the column driver 10 is controlled to achieve all luminance transitions that require a positive voltage difference. According to the present invention a final portion of a voltage sequence generated by the column controller is selected from a plurality of mutually different sequence portions, to achieve mutually different luminance transitions, wherein at least a first and a second of this plurality of sequence portions mutually have the same number of voltage levels occurring the same number of times, but having said voltage levels occur in a mutually different order.

In the claims the word "comprising" does not exclude other elements or steps, and the indefinite article "a" or "an" does not exclude a plurality. A single component or other unit may fulfill the functions of several items recited in the claims. The mere fact that certain measures are recited in mutually different claims does not indicate that a combination of these measures cannot be used to advantage. Any reference signs in the claims should not be construed as limiting the scope.

Although the present invention has been described for an active matrix type display, the invention is also applicable to a so called "direct drive" type of display.

In order to achieve a well defined fine grey level distribution it is advised to regularly reset the pixels to the well defined reset state. In an embodiment the device may in addition have a fast driving mode, wherein the luminance is directly changed from a present grey value to a desired grey value. This alternative driving mode is less accurate, but is still useful if a lower number of grey values, e.g. 4 is acceptable.

Although the present invention has been specifically described in the context of its application to the preparatory portion of the set sequence, its application may also be suitable to other display control phases. For example it may be considered to apply respective permutations of a basis control sequence in the final portion of the set sequence corresponding to respective final states. Or it may be considered to apply this to the reset subsequence to even better erase differences between various original states.

What is claimed is:

1. A device for driving a bistable display, the device comprising:

a processor for receiving an input signal indicative for a desired luminance of a pixel of the bistable display;

a controlling circuit for determining a sequence of voltage levels to achieve a transition from a present luminance to the desired luminance; and a voltage generator for generating the sequence of voltage levels, a portion of the sequence of voltage levels being selected from a plurality of mutually different sequence portions, to achieve different luminance transitions, and at least a first and a second of the plurality of mutually different sequence portions having a same set of voltage levels, having the voltage levels from that set occurring the same number of times in the first and the second sequence portion and having said voltage levels from that set arranged in a different order in the first and the second sequence portion;

wherein the sequence comprises a reset subsequence and a set subsequence, the set subsequence following the reset subsequence, the reset subsequence has the effect that the at least one pixel is reset to a reset state having a reset luminance, and the set subsequence causes a state transition of said pixel from the reset state to a state having the desired luminance;

wherein the set subsequence comprises a first, preparatory portion that results in a transition of the reset state having the reset luminance to a preparatory intermediary value and a second, final portion following the first, preparatory portion that results in a transition of the luminance from said preparatory intermediary value to said desired value; and wherein the preparatory set subsequence portion is the portion of the sequence that is selected from the plurality of mutually different sequence portions, to achieve mutually different luminance transitions.

2. The device according to claim 1, wherein the reset luminance of the reset state is equal to a first or a second luminance.

3. The device according to claim 2, wherein a curve of the luminance variation as a function of the time the voltage is applied comprises a steep region, and wherein a position of said preparatory intermediary level is selected substantially at an end portion of said steep region, preferably beyond the steep region.

4. The device according to claim 1, wherein a curve of the luminance variation as a function of the time the voltage is applied comprises a steep region, and wherein a position of said preparatory intermediary level is selected substantially at an end portion of said steep region, preferably beyond the steep region.

5. The device according to claim 1, wherein, wherein the frame time is in the range of 4 ms to 100 ms.

6. The device according to claim 1, comprising: a row driver configured to provide a row voltage; a row electrode connected to the row driver; a column driver configured to provide at least three column voltage levels; a column electrode connected to the column driver; a common electrode driver configured to provide at least two common voltage levels; a common electrode connected to the common driver; a pixel connected between the column electrode and the common electrode; and a controller configured to control timing of application of the N column voltage levels relative the common voltage levels to provide effective pixel voltage levels across the pixel.

7. A system comprising:

a bistable display; and a device according to claim 1 for driving said display.

8. The system according to claim 7, wherein the display comprises an electrophoretic material.

9. The system according to claim 8, wherein the display is flexible.

10. The system according to claim 7, wherein the display is flexible.

11. A method for driving a bistable display, the method comprising:

providing an input signal representative for a desired luminance of a pixel of the bistable display; and determining a sequence of voltage levels to be applied for changing the luminance of the pixel from a present luminance to the desired luminance, wherein a portion of the sequence of voltage levels is selected from a plurality of mutually different sequence portions, to achieve different luminance transitions, and at least a first and a second of the plurality of mutually different sequence portions have a same set of voltage levels, wherein the voltage levels from that set occur the same number of times in the first and the second sequence portion and having said voltage levels occur in a different order in the first and the second sequence portion;

wherein the sequence comprises a reset subsequence and a set subsequence, the set subsequence following the reset subsequence, the reset subsequence has the effect that the at least one pixel is reset to a reset state having a reset luminance, and the set subsequence causes a state transition of said pixel from the reset state to a state having the desired luminance;

wherein the set subsequence comprises a first, preparatory portion that results in a transition of the reset state having the reset luminance to a preparatory intermediary value and a second, final portion following the first, preparatory portion that results in a transition of the luminance from said preparatory intermediary value to said desired value; and wherein the preparatory set subsequence portion is the portion of the sequence that is selected from the plurality of mutually different sequence portions, to achieve mutually different luminance transitions.

* * * * *